US007758402B2

(12) United States Patent
Yoshida et al.

(10) Patent No.: US 7,758,402 B2
(45) Date of Patent: Jul. 20, 2010

(54) WAFER GRINDING METHOD

(75) Inventors: Shinji Yoshida, Ota-ku (JP); Osamu Nagai, Ota-ku (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 11/906,853

(22) Filed: Oct. 4, 2007

(65) Prior Publication Data

US 2008/0090505 A1 Apr. 17, 2008

(30) Foreign Application Priority Data

Oct. 11, 2006 (JP) ..... 2006-277525

(51) Int. Cl.
*B24B 1/00* (2006.01)

(52) U.S. Cl. ..... 451/11; 451/41; 451/57; 257/E21.237; 438/959

(58) Field of Classification Search ..... 451/11, 451/41, 57, 58, 65, 285, 287; 257/E21.214, 257/E21.237; 438/692, 959
See application file for complete search history.

(56) References Cited

U.S. PATENT DOCUMENTS

| | | | | |
|---|---|---|---|---|
| 2004/0137698 | A1* | 7/2004 | Taraschi et al. | 438/458 |
| 2005/0142815 | A1* | 6/2005 | Miyazaki et al. | 438/464 |
| 2007/0004180 | A1* | 1/2007 | Abe | 438/460 |
| 2007/0141955 | A1* | 6/2007 | Masuda | 451/11 |

FOREIGN PATENT DOCUMENTS

| | | |
|---|---|---|
| JP | 2004-281551 | 10/2004 |
| JP | 2005-123425 | 5/2005 |

* cited by examiner

*Primary Examiner*—Eileen P. Morgan
(74) *Attorney, Agent, or Firm*—Greer, Burns & Crain, Ltd.

(57) ABSTRACT

A recessed portion is formed in an area, of a rear surface of a wafer, corresponding to a device formation area is formed by a rough grinding wheel of a rough grinding unit and an annular protruding portion is concurrently formed around the recessed portion. The inner circumferential lateral surface of the recessed portion is next ground by a finishing grinding wheel of a finishing grinding unit and the bottom surface is subsequently ground.

1 Claim, 10 Drawing Sheets

WAFER GRINDING METHOD

BACKGROUND OF THE INVENTION

1. Field of the Invention

The present invention relates to a method of grinding the rear surface of a wafer such as a semiconductor wafer to reduce the thickness of the wafer. In particular, the invention relates to a technique for grinding only an area of a wafer corresponding to an area formed with a device on its surface so as to form a cross-sectionally recessed portion in the wafer.

2. Description of the Related Art

Semiconductor chips used for various electronics are generally manufactured by the following method. The front surface of a disklike semiconductor wafer is sectioned into lattice-like rectangular areas by predetermined dividing lines. Electronic circuits such as IC, LSI and the like are formed on the front surfaces of such rectangular areas. The rear surface of the wafer is ground to thin the entire wafer and the wafer is then divided into the semiconductor chips along the predetermined dividing lines. The thinning by the rear surface grinding is performed by a method in which a semiconductor wafer is sucked and held on a vacuum chuck type chuck table with the rear surface to be ground exposed and rotating grindstones are pressed against the rear surface of the semiconductor wafer.

Incidentally, electronics have significantly been downsized and thinned in recent years and along with this also thinner semiconductor chips are required. This causes the necessity that semiconductor wafer should be thinner than conventional one. However, thinning the semiconductor wafer reduces its rigidity, which poses a problem in that handling after the thinning process becomes difficult and the wafer is likely to crack. To eliminate the problem, only a circular device area formed with semiconductor chips are ground from the rear surface side thereof to thin the wafer. In addition, an annular outer circumferential redundant area around the device area is left to have an original thickness and to form an annular protruding portion protruding toward the rear surface side. Thus, the entire wafer is processed to form a portion recessed in cross-section on the rear surface thereof. See Japanese Patent Laid-open Nos. 2004-281551 and 2005-123425. Such a semiconductor wafer is easy to handle and unlikely to crack since the annular protruding portion serves as a reinforcing portion to ensure rigidity.

Grinding processing for forming a recessed portion on the rear surface of a wafer may be performed by using a high-mesh grindstone containing abrasive grains of #2000 or more for finishing grinding. Such a case provides the following advantages: A mechanical damage layer lowering transverse rupture strength on the to-be-ground surface or a recessed portion inner surface can be suppressed to a low level. In addition, since the inner circumferential lateral surface of the annular protruding portion is ground concurrently with the bottom surface of the recessed portion, only one grinding process is required. FIG. 10A illustrates such a method of forming the recessed portion at an area of the rear surface corresponding to the device formation area. In this case, the rear surface (the upper surface in the figure) of the wafer 1 is ground by a finishing grindstone 101 secured to a grinding wheel 100 rotating at a high speed to form a recessed portion 1A and an annular protruding portion 5A protruding on the rear surface side around the device formation area. However, this method performs the grinding with the finishing grindstone 101 from the beginning; therefore, grinding performance for a grinding amount enough to form the recessed portion 1A deteriorates. This prolongs processing time to make the processing inefficient.

As illustrated, an outer circumferential side corner of the grindstone 101 is removed or rounded because of the increased grinding load, so that an inner corner portion formed between the bottom portion 4*a* of the recessed portion and the inner circumferential lateral surface 5B of the annular protruding portion 5A is ground in an R-shape. Because of this, the outermost circumferential portion of the device formation area indicated with symbol "NG" is not ground to a target thickness. The area of the actual device formation area is reduced to reduce the obtainable number or yield of the semiconductor chips. This problem is solved by dressing the grindstone 101 having a rounded corner to form the corner at a right angle as shown in FIG. 10B. However, the dressing is needed to consequently deteriorate productivity and shorten the operating life of the grindstone.

Then, a two-step grinding method is effective in reducing the processing time although the processes are increased. This two-step grinding method involves grinding the rear surface of a wafer with a rough grindstone containing abrasive grains of e.g. #320 to #600 to form a recessed portion and then performing finishing grinding with a finishing grindstone. However, it is difficult for this method to position a finishing grindstone at the inner circumferential lateral surface of the annular protruding portion so as to conform to the shape and dimensions of the roughly ground recessed portion. A technique has not been established in which the transverse movement of the grindstone toward the inner circumferential lateral surface while performing minute adjustment. Therefore, the finishing grinding is performed only on the bottom surface 4*a* of the recessed portion 1A as shown in FIG. 10C. A broken line of this figure indicates the bottom surface of the recessed portion 1A formed by the rough grinding. As described above, the finishing grinding performed only on the bottom surface 4*a* of the recessed portion 1A does not perform the finishing grinding on the outermost circumferential portion of the bottom surface 4*a*, whereby the device formation region is narrowed by the non-ground portion "NG". Also in this case, the yield of semiconductor chips is reduced.

SUMMARY OF THE INVENTION

Accordingly, it is an object of the present invention to provide a wafer grinding method that can ensure an original area of a device formation area even after finishing grinding in performing rear surface grinding for forming a recessed portion is performed by two-step grinding in which finishing grinding is performed after rough grinding, and that can efficiently perform grinding without reduction in the yield of semiconductor chips.

In accordance with an aspect of the present invention, there is provided a method of grinding a wafer having a device formation area formed with a plurality of devices on a front surface thereof, including: a first grinding step in which the wafer is held on a rotatable chuck table with a rear surface thereof upside, and an area of the rear surface corresponding to the device formation area is ground by an annular rotary type first grindstone or an annularly arranged rotary type first grindstones to form a recessed portion in the rear surface side of the wafer, thereby forming an annular protruding portion protruding from the rear surface side around the device formation area; and a second grinding step in which a bottom surface of the recessed portion and an inner circumferential lateral surface which constitute an inner surface of the recessed portion are ground by a second grindstone which is an annular rotary type grindstone or annularly arranged rotary type grindstones and which has an abrasive grain size smaller than that of the first grindstone and a grinding outer diameter equal to or greater than that of the first grindstone.

In the grinding method of the present invention, when the rear surface of the wafer is ground, the most amount of the total grinding amount is ground in the first grinding step and the remaining slight amount is ground, thereby finishing the rear surface evenly in the second grinding step. Accordingly, the first grindstone used in the first grinding step has a relatively large grain size and the second grindstone used in the second grinding process has a small grain size for finishing grinding. In the first grinding step, only the area of the wafer rear surface corresponding to the device formation area is first ground and the portion surrounding the device formation area is left as the annular protruding portion. In the second grinding step, the entire surface of the recessed portion, namely, the bottom surface of the recessed portion and the inner circumferential lateral surface of the annular protruding portion are ground. The grinding of the recessed portion inner surface in the second grinding step has a method of separately grinding the bottom surface and the inner circumferential lateral surface, such as of grinding first the inner circumferential lateral surface of the annular protruding portion and then the bottom surface of the recessed portion. Incidentally, the order of grinding may be reverse, that is, a method may be adopted of grinding first the bottom surface of the recessed portion and then the inner circumferential lateral surface of the annular protruding portion.

According to the present invention, the entire inner surface of the recessed portion can efficiently be machined into an even plane having a mechanical damage layer with a low level by the two-step grinding in which the recessed portion is formed by the rough grinding of the first grinding step and then the recessed portion inner surface is ground by the second grinding step. The inner circumferential lateral surface of the annular protruding portion together with the bottom surface of the recessed portion is appropriately finishing-ground. This makes it possible to ensure the uniform thickness of the outermost circumferential portion of the device formation area and to prevent the reduction of the device formation area and the reduction of the yield of the devices along with the reduction of the device formation.

The present invention can produce an effect that promotion of streamlining the rear surface grinding by formation of the recessed portion and ensuring of the device formation area can be compatible with each other, resulting in an improvement in productivity.

The above and other objects, features and advantages of the present invention and the manner of the realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENT

An embodiment of the present invention will hereinafter be described with reference to the drawings.

[1] Semiconductor Wafer

Figure 1A:
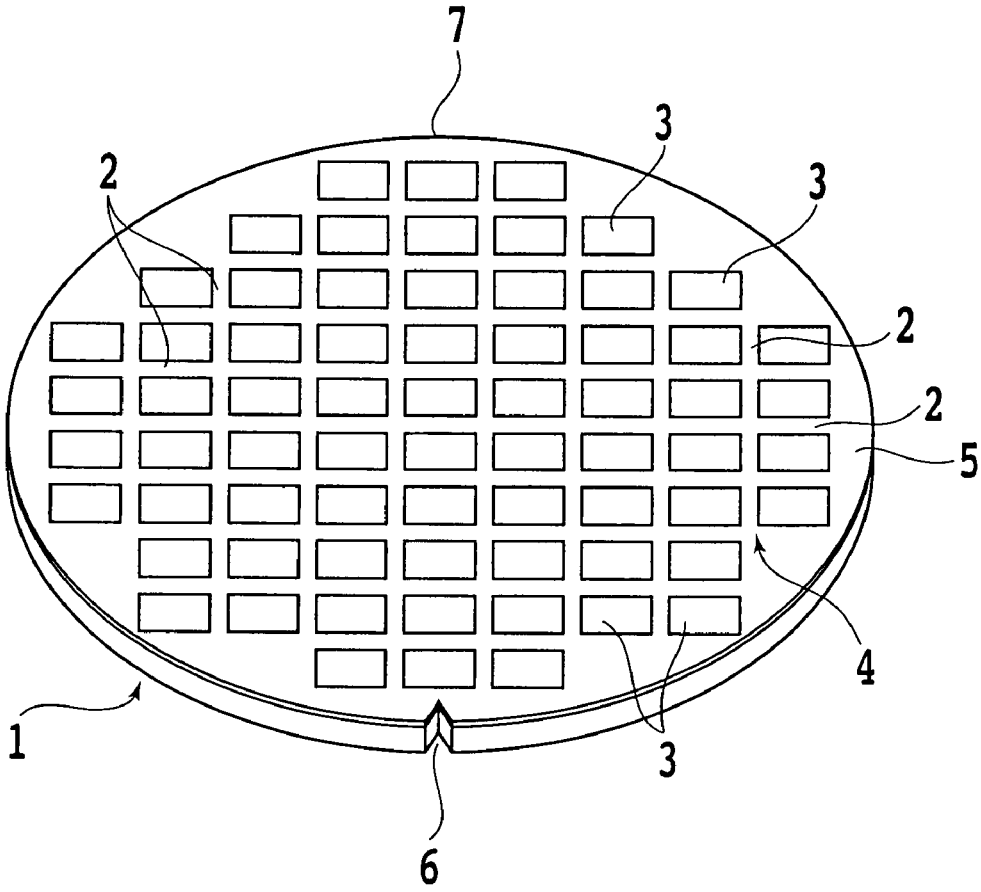
FIG. 1A is perspective view of a wafer whose rear surface is ground to form a recessed portion by a wafer grinding method according to an embodiment of the present invention.

Reference numeral 1 in FIGS. 1A and 1B denotes a disk-like semiconductor wafer (hereinafter abbreviated to the wafer) whose rear surface is ground by a wafer-grinding method of an embodiment to reduce the thickness thereof. The wafer 1 is a silicon wafer or the like and has a thickness of e.g. about 600 to 700 μm before the processing. The front surface of the wafer 1 is sectioned into a plurality of rectangular semiconductor chips (devices) 3 along lattice-like predetermined dividing lines 2. Electronic circuits such as IC, LSI and the like not shown are formed on the front surface of the semiconductor chips 3.

The plurality of semiconductor chips 3 are formed in an almost-circular device formation area 4 formed concentrically with the wafer 1. The device formation area 4 occupies a large portion of the wafer 1 and a wafer outer circumferential portion around the device formation area 4 is an annular outer-circumferential redundant area 5 formed with no semiconductor chips 3. A V-shaped notch 6 indicating the crystal orientation of the semiconductor is formed at a predetermined position on the circumferential surface of the wafer 1. This notch 6 is formed in the outer-circumferential redundant area 5. The wafer 1 is finally cut and divided along the predetermined dividing lines 2 into the plurality of individual semiconductor chips 3. The wafer grinding processing method according to the present embodiment involves grinding an area on the rear surface of the wafer 1 corresponding to the device formation area 4 to reduce the thickness thereof before the division into the individual semiconductor chips 3.

Figure 1B:
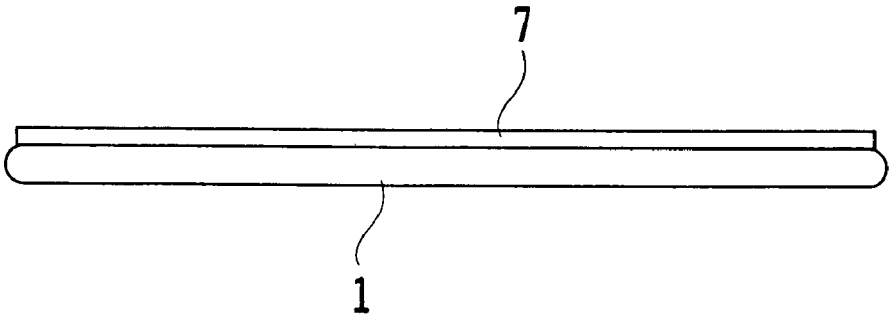
FIG. 1B is a lateral view of FIG. 1A.

When the rear surface of the wafer 1 is ground, as shown in FIG. 1B, a protection tape 7 is stuck on the surface formed with the electronic circuits for the purpose of protecting the electronic circuits and for any other purpose. The protection tape 7 to be used is structured such that, for example, an adhesive with a thickness of about 5 to 20 μm is applied to one side of a soft base sheet made of resin such as polyolefin and having a thickness of about 70 to 200 μm. The protection tape 7 is stuck with the adhesive conforming to the rear surface of the wafer 1.

[2] Configuration of the Wafer-Grinding Apparatus

Figure 2:
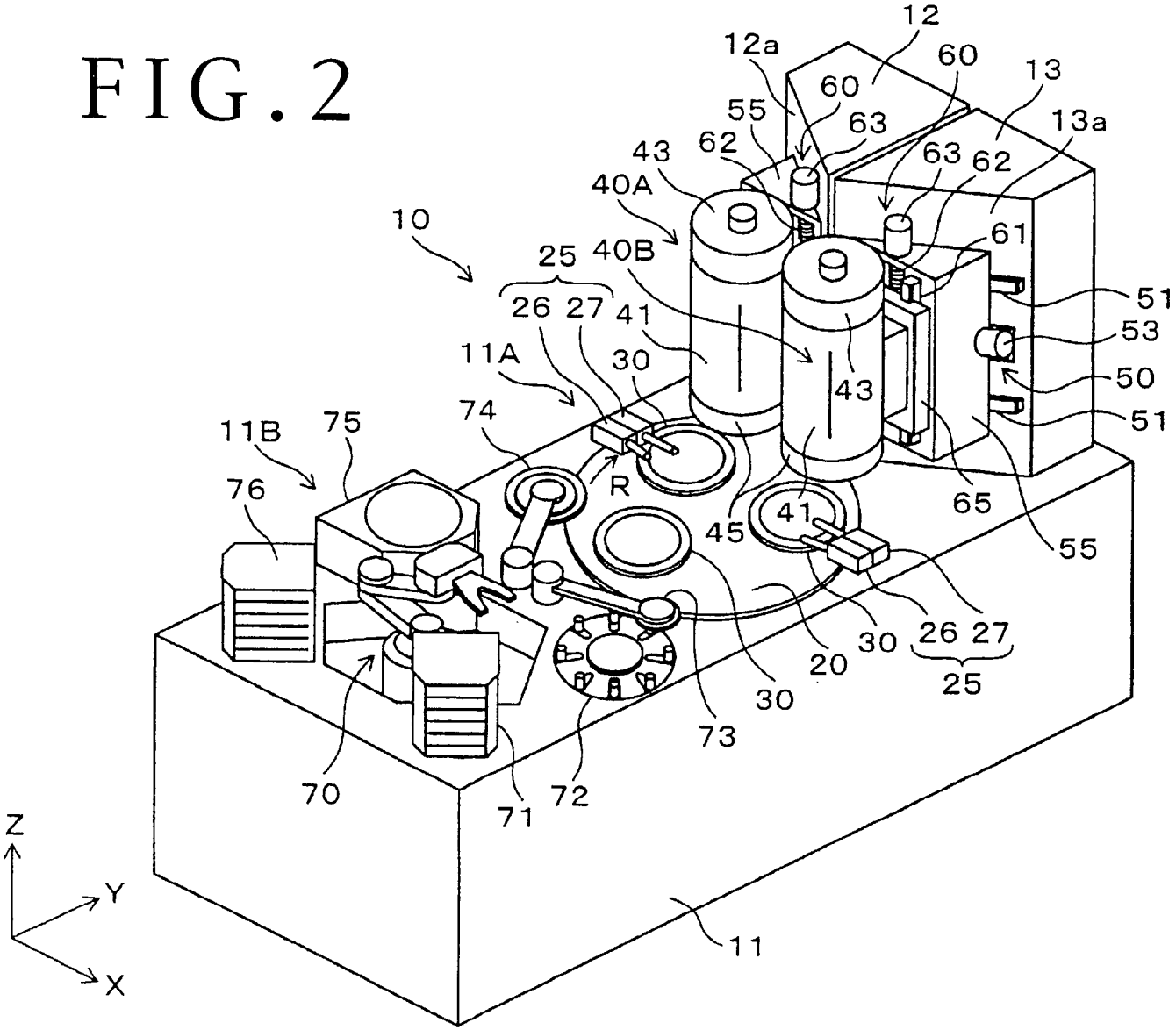
FIG. 2 is a perspective view of a wafer-grinding apparatus to which the wafer grinding method according to the embodiment of the present invention can preferably be applied.

A description is next made of a wafer-grinding processing apparatus (wafer-grinding apparatus) to which the method of the present embodiment can preferably be applied. FIG. 2 illustrates the entire wafer-grinding apparatus 10. The wafer-grinding apparatus 10 includes a rectangular parallelepipedic base 11 with a flat upper surface. In FIG. 2, the longitudinal direction of the base 11, a horizontal width direction perpendicular to the longitudinal direction and a vertical direction are indicated with a Y-direction, an X-direction and a Z-direction, respectively. A pair of columns 12, 13 juxtaposed to each other in the X-direction (here the left-right direction) are provided at one end of the base 11 in the Y-direction so as to extend upright. On the base 11 a processing area 11A where the wafer 1 is ground is provided close to the columns 12, 13 in the Y-direction. On a side opposite to the columns 12, 13 an attachment/detachment area 11B is provided where the wafer 1 to be processed is fed to the processing area 11A and the wafer 1 processed is recovered.

A disklike turn table is rotatabilty provided in the processing area 11A so as to have a rotational axis parallel to the Z-direction and a horizontal upper surface. This turn table 20 is turned in the direction of arrow R by a rotational drive mechanism not shown. A plurality of disklike chuck tables 30 are provided on the outer circumferential portion of the turn table 20 so as to be circumferentially equally spaced apart from each other. Each of the chuck tables 30 has a rotational shaft parallel to the Z-direction and a horizontal upper surface.

The chuck table 30 is of generally well-known vacuum chuck type and sucks and holds the wafer 1 placed on the upper surface thereof. Referring to FIGS. 3A, 3B, 4A and 4B, each chuck table 30 is provided with a circular suction area 32 made of porous ceramics material on the upper surface central portion of a disklike frame 31. The frame 31 is formed with an annular upper surface 31*a* around the suction area 32. Both the annular upper surface 31*a* and the upper surface 32*a* of the suction area 32 are horizontal and are evenly formed flush with each other (the chuck table upper surface 30A). The chuck tables 30 are each rotated on its axis in one direction or in both directions by the rotational drive mechanism provided in the turn table 20 and moves around the axis of the turn table 20 when the turn table 20 is rotated.

As shown in FIG. 2, in the state where two chuck tables 30 are located close to the columns 12, 13 so as to be aligned in the X-direction, a rough grinding unit 40A and a finishing grinding unit 40B are disposed right above the two chuck tables 30 in order from the upstream side of the rotational direction of the turn table 20. The chuck tables 30 are each positioned at three positions by the intermittent rotation of the turn table 20. The three positions consists of a rough grinding position below the rough grinding unit 40A, a finishing grinding position below the finishing grinding unit 40B and an attachment/detachment position closest to the attachment/detachment area 11B.

The rough grinding unit 40A and the finishing grinding unit 40B are attached to the corresponding columns (to the rough grinding side column 12 and the finishing grinding side column 13, respectively). The attachment structures of the rough grinding unit 40A and the finishing grinding unit 40B to the columns 12 and 13, respectively, are the same and symmetrical with respect to the X-direction. Thus, the attachment structure on the finishing grinding side is representatively described with reference to FIG. 2.

A front surface 13*a* of the finishing grinding side column 13 facing the processing area 13 is formed as a vertical surface relative to the upper surface of the base 11. And as a taper surface which obliquely extends toward the back (a side opposite to the attachment/detachment area 11B) at a predetermined angle as it goes from the center of the X-direction toward the end. This taper surface 13*a* (a taper surface 12*a* for the rough grinding side column 12) is set so as to be parallel to a line joining the rotational center of the chuck table 30 positioned at the finishing grinding position with the rotational center of the turn table 20. An X-axis slider 55 is attached to the taper surface 13*a* through an X-axis transfer mechanism 50. In addition, a Z-axis slider 65 is attached to the X-axis slider 55 through the Z-axis transfer mechanism 60.

The X-axis transfer mechanism 50 includes a pair of upper and lower guide rails 51 secured to the taper surface 13*a* (12*a*); a screw rod not shown disposed between the guide rails 51 so as to be threaded to and pass through the X-axis slider 55; and a motor 53 which normally and inversely rotates the screw rod. Both the guide rails 51 and screw rod extend parallel to the taper direction of the taper surface 13*a* (12*a*). The X-axis slider 55 is slidably attached to the guide rails 51. The X-axis slider 55 receives the power of the screw rod rotated by the motor 53 to reciprocate along the guide rails 51. The reciprocating direction of the X-axis slider 55 is parallel to the extending direction of the guide rails 51, namely, to the taper direction of the taper surface 13*a* (12*a*).

The front surface of the X-axis slider 55 is a plane extending along X- and Z-directions and the Z-axis transfer mechanism 60 is attached to the front surface. The Z-axis transfer mechanism 60 is configured such that the transfer direction of the X-axis transfer mechanism 50 is changed to the Z-direction. The Z-axis transfer mechanism 60 includes a pair of left and right guide rails 61 (only the right one is seen in FIG. 2) secured to the front surface of the X-axis slider 55 and extending in the Z-direction; a screw rod 62 disposed between the guide rails 61 so as to be threaded to and pass through the Z-axis slider 65 and extending in the Z-direction; and a motor 63 which normally and inversely rotates the screw rod 62. The Z-axis slider 65 is slidably attached to the guide rails 61 and is moved upward and downward along the guide rails 61 by the power of the screw rod 62 rotated by the motor 63.

A front surface 12*a* of the rough grinding side column 12 facing the processing area 11A is formed, symmetrically to the finishing grinding side column 13, as a taper surface which obliquely extends toward the back at a predetermined angle as it goes from the center of the X-direction toward the end. An X-axis slider 55 is attached to the taper surface 12*a* through an X-axis transfer mechanism 50. In addition, a Z-axis slider 65 is attached to the X-axis slider 55 through the Z-axis transfer mechanism 60. The taper direction of the taper surface 12*a* of the rough grinding side column 12 is set so as to be parallel to a line joining the rotational center of the chuck table 30 positioned at the rough grinding position with the rotational center of the turn table 20. The rough grinding unit 40A and the finishing grinding unit 40B are secured to the Z-axis sliders 65 attached to the rough grinding side column 12 and the finishing grinding side column 13, respectively.

Figure 3B:
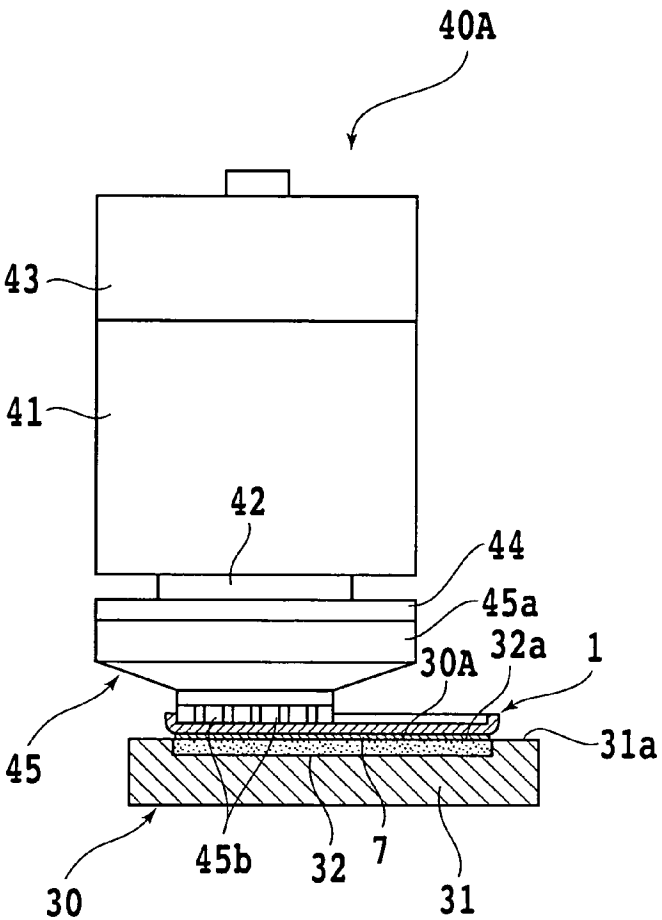
FIG. 3B is a lateral view of FIG. 3A.
Figure 3A:
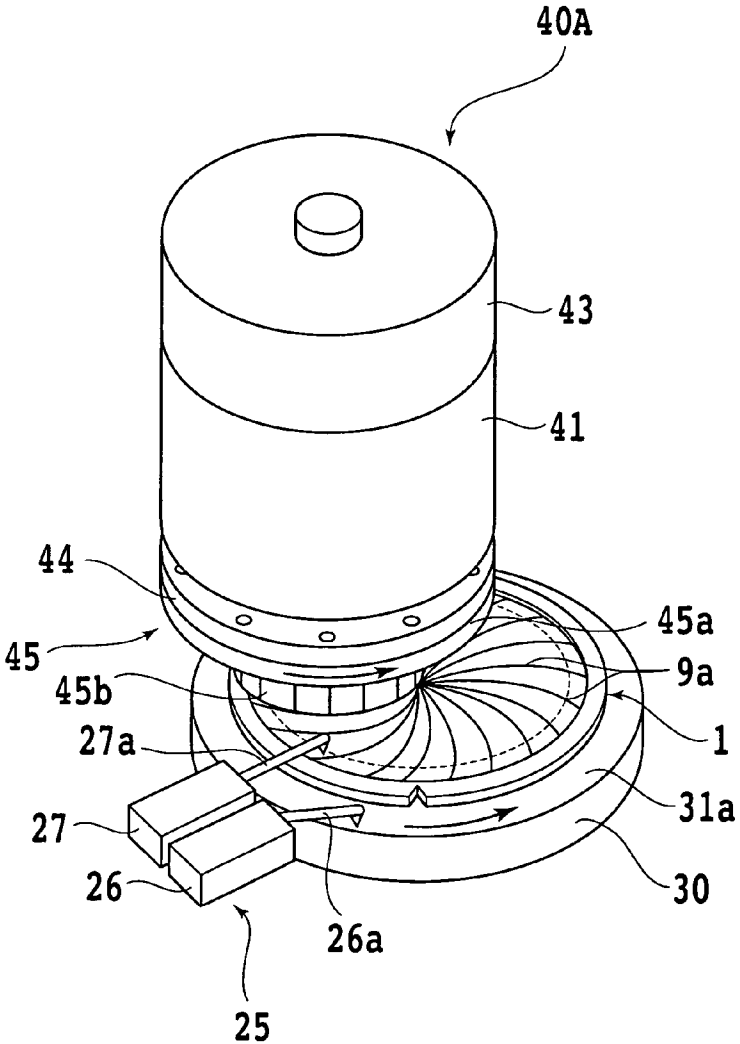
FIG. 3A is a perspective view of a rough-grinding unit of the apparatus.

As shown in FIGS. 3A and 3B, the rough grinding unit 40A includes a tubular spindle housing 41 having an axis extending in the Z-direction; a spindle shaft 42 coaxially and rotatably supported inside the spindle housing 41; a motor 43 secured to the upper end of the spindle housing 41 to rotatably drive the spindle shaft 42; and a disklike flange 44 coaxially secured to the lower end of the spindle shaft 42. A rough grinding wheel 45 is detachably attached to the flange 44 by means such as screw cramp or the like.

The rough grinding wheel 45 is configured such that a plurality of rough grindstones (first grindstones) 45*b* are secured to the lower end face of the frame 45*a* so as to be annularly arranged and extend along the entire outer circumferential portion of the lower end face. The frame 45*a* is annularly formed to have a conical lower surface. The grindstones 45*b* are made by mixing diamond abrasive grains with a glassy sintering material called vitrified and sintering the mixture. It is preferred that the grindstone 45*b* have abrasive grains of e.g. #320 to #400.

The grinding outer diameter of the rough grinding wheel 45, namely, the diameter of outer circumferential edge of the annularly arranged grindstones 45*b* is set to a value equal to or less than the radius of the wafer 1. Such dimensions are set to enable the formation of a recessed portion 1A shown in FIGS. 6A and 6B by the following. A blade edge or lower end face of the grindstone passes the rotational center of the wafer 1 concentrically held on the rotating chuck table 30. In addition, the outer circumferential edge of the blade edge coincides with and passes the outer circumferential edge of the device formation area (the boundary between the device formation area 4 and the outer circumferential redundant area 5). Thus, only an area corresponding to the device formation area 4 is ground.

Figure 4B:
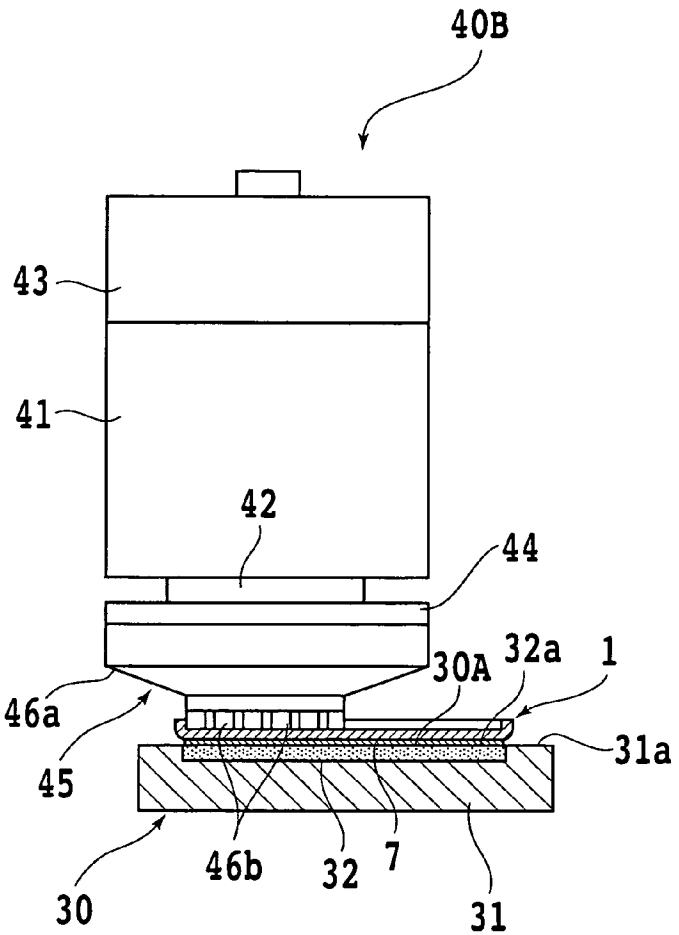
FIG. 4B is a lateral view of FIG. 4A.
Figure 4A:
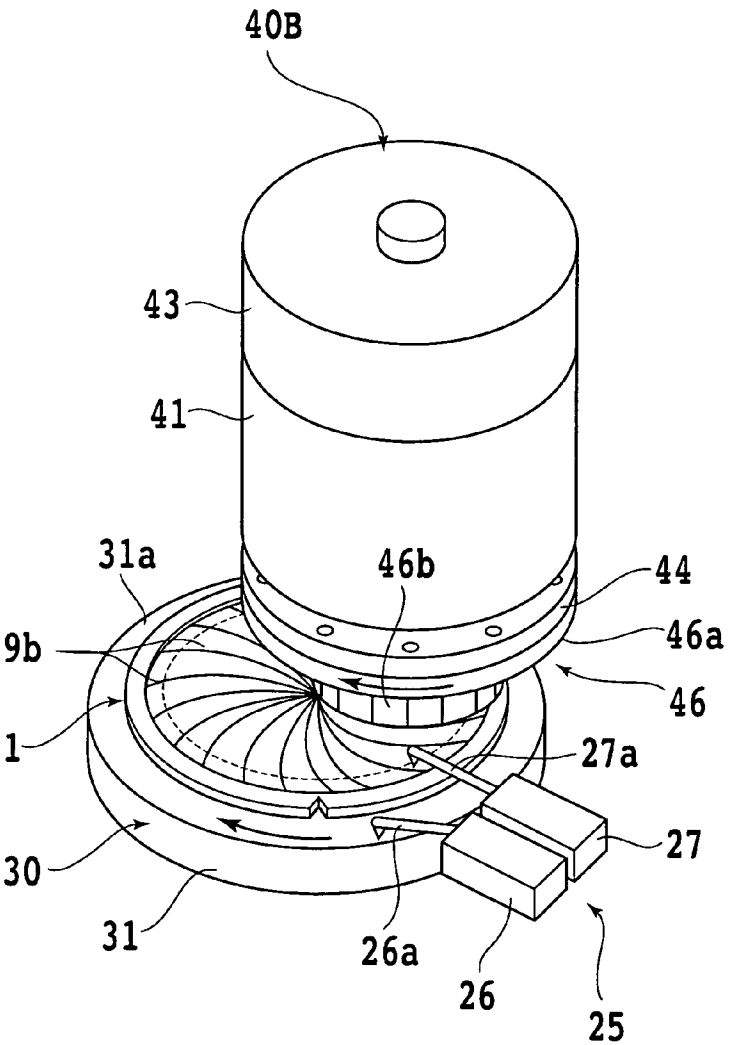
FIG. 4A is a perspective view a finishing grinding unit of the apparatus.

The finishing grinding unit 40B has the same configuration as the rough grinding unit 40A and includes a spindle housing 41, a spindle shaft 42, a motor 43 and a flange 44 as shown in FIGS. 4A and 4B. A finishing grinding wheel 46 is detachably attached to the flange 44. The finishing grinding wheel 46 is configured such that a plurality of finishing grindstones (second grindstones) 46*b* are secured to the lower surface of the frame 46*a* similar to the flame 45*a* of the rough grinding wheel 45 so as to be annularly arranged and extend along the entire outer circumferential portion of the lower surface. The finishing grindstone 46*b* contains abrasive grains having a grain size smaller than that of the rough grindstone 45*b*. It is preferred that the grindstone 45*b* have abrasive grains of e.g. #2000 to #8000.

Figure 6A:
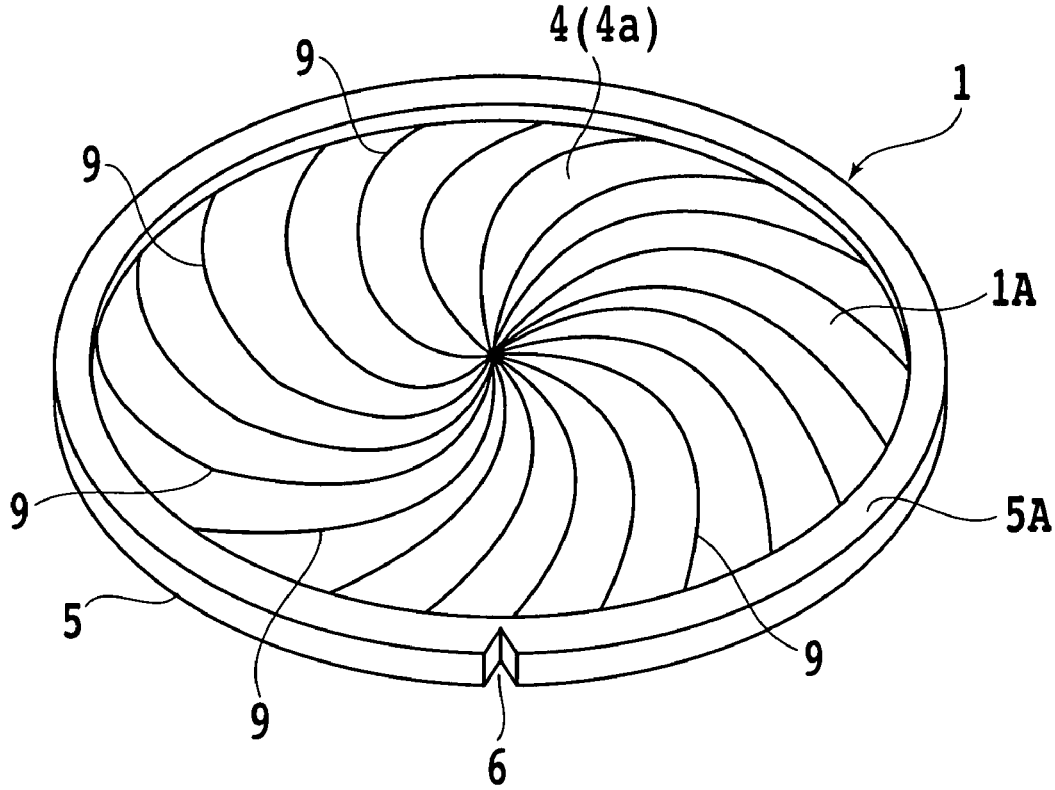
FIG. 6A is a perspective view formed with the recessed portion in the rear surface of the wafer by the rough grinding step.
Figure 6B:
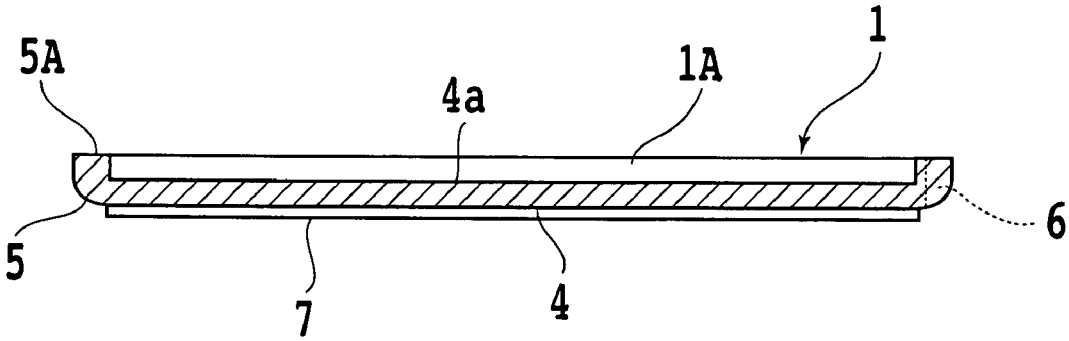
FIG. 6B is a cross-sectional view of FIG. 6A.
Figure 7A:
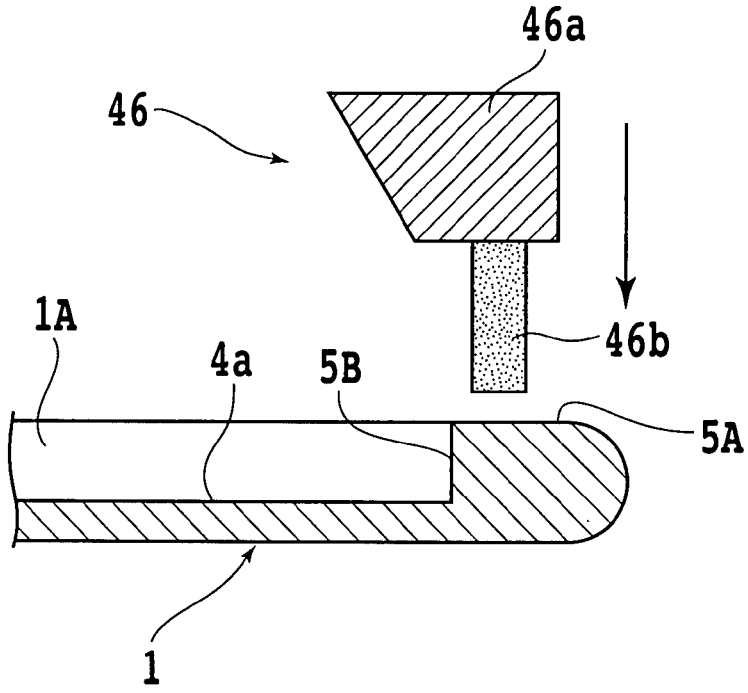
FIGS. 7A and 7B are cross-sectional views illustrating steps of grinding the rear surface of the wafer for finishing-grinding the inner surface of the recessed portion by a method according to a first embodiment of the present invention.

It is necessary that the grinding outer diameter of the finishing grinding wheel 46 is almost equal to the radius of the wafer 1 and equal to or greater than the grinding outer diameter of the rough grinding wheel 45. Such dimensions are set so that the blade edge of the grindstone 46*b* passes the rotational center of the wafer 1 concentrically held on the rotating chuck table 30 and the grindstone 46*b* can grind an inner circumferential lateral surface 5B of an annular protruding portion 5A as shown in FIGS. 6A and 6B. Preferable dimensions are such that the width portion (the radial length portion) of the grindstone 46*b* is located on the outer circumferential side of the inner circumferential lateral surface 5B and the entire surface of the blade edge of the grindstone 46*b* comes into contact with the upper surface of the annular convex portion 5A as shown in FIG. 7A.

The rough grinding unit 40A is positionally set such that the rotational center of the rough grinding wheel 45 (the axial center of the spindle shaft 42) is located right above a line joining the rotational center of the chuck table 30 positioned at the rough grinding position with the rotational center of the turn table 20. The rough grinding unit 40A reciprocates along the taper direction of the taper surface 12*a* of the column 12 along with reciprocation of the Z-axis slider 65. Thus, during the reciprocation of the rough grinding unit 40A, the rotational center of the rough grinding wheel 45 reciprocates right above a line joining the rotational center of the chuck table 30 positioned at the rough grinding position with the rotational center of the turn table 20. This reciprocative direction is hereinafter referred to as "the inter-axis direction" because it is a direction between the axis of the chuck table 30 and the axis of the turn table 20.

The positional setting described above applies to the finishing grinding unit 40B. The rotational center of the finishing grinding wheel 46 of the finishing grinding unit 40B is located right above a line joining the rotational center of the chuck table 30 positioned at the finish grinding position with the rotational center of the turn table 20. When the finishing grinding unit 40B reciprocates along the taper direction of the taper surface 13*a* of the column 13 along with the Z-axis slider 65 and X-axis slider 55, the rotational center of the finishing grinding wheel 46 reciprocates right above and in the direction of, namely, in the inter-axis direction of the line joining the rotational center of the chuck table 30 positioned at the finish grinding position with the rotational center of the turn table 20.

As shown in FIG. 2A, thickness-measuring gauges 25 which measure the thicknesses of wafers on the chuck tables 30 positioned at the rough grinding position and finishing grinding position are disposed on the base 11. These thickness-measuring gauges 25 are each composed of a combination of a reference side height gauge 26 with a wafer side height gauge 27. The reference side height gauge 26 detects the height position of the chuck table upper surface 20A by the tip of a swinging reference probe 26*a* coming into contact with the upper surface 21*a* of the frame 21 of the chuck table 20 not covered by the wafer 1.

The wafer side height gauge 27 detects the height position of the upper surface of the wafer 1 by the tip of a swinging variation prove 27*a* coming into contact with the upper surface, namely, the to-be-ground surface of the wafer 1 held on the chuck table 30. The thickness-measuring gauge 25 determines the thickness of the wafer 1 based on a value obtained by subtracting a measurement value of the reference side height gauge 26 from a measurement value of the wafer side height gauge 27. If the wafer 1 is ground to a target thickness: t1, an original thickness t2 is first measured before the grinding and (t2–t1) is taken as a ground amount. Incidentally, it is preferred that a thickness measurement point of the wafer 1 with which the variation probe 27*a* of the wafer side height gauge 27 comes into contact be located at an outer circumferential portion close to the outer circumferential edge of the wafer 1 (the outer circumferential edge of the device formation area 4) as shown broken lines of FIGS. 3A and 4A.

The configuration relating to the processing area 11A on the base 11 has been described thus far. The attachment/detachment area 11B is next described with reference to FIG. 2. A two-joint link type pick-up robot 70 which moves upward and downward is installed at the center of the attachment/detachment area 11B. A supply cassette 71, a positioning table 72, a supply arm 73, a recovery arm 74, a spinner type cleaning system 75 and a recovery cassette 76 are arranged around the pick-up robot 70 counterclockwise as viewed from above.

The cassette 71, the positioning table 72 and the supply arm 73 constitute means for supplying the wafer 1 to the chuck table 30. The recovery arm 74, the cleaning system 75 and the cassette 76 constitute means for recovering the wafer with the ground rear side from the chuck table 30 and transferring it to the subsequent process. The cassettes 71, 76 store a plurality of the wafers 1 in such a stacked manner as to take a horizontal posture and to be spaced apart from each other above and below. The cassettes 71, 76 are disposed at respective predetermined positions on the base 11.

A single wafer 1 is taken out of the supply cassette 71 by the pick-up robot 70 and placed on the positioning table 72 with the rear side not stuck with the protection tape 7 facing upside, thus, being positioned at a given position. The wafer 1 is next picked up from the positioning table 72 by the supply arm 73 and placed on the chuck table 30 standing by at the attachment/detachment position. On the other hand, the wafer 1 whose rear side is ground by the grinding units 40A, 40B and positioned at the attachment/detachment position is picked up by the recovery arm 74, and transferred to the cleansing system 75, where it is cleaned with water and dried. The wafer 1 that has been cleaned by the cleaning system 75 is transferred by the pick-up robot 70 into the recovery cassette 76 for storage.

[3] Operation of the Wafer-Grinding Apparatus

The configuration of the wafer-grinding apparatus 10 is as described above. A description is next made of operation of grinding the rear surface of the wafer 1 by the wafer-grinding apparatus 10. This operation includes a wafer grinding processing method according to the present invention. A single wafer 1 stored in the supply cassette 71 is transferred to and positioned at the positioning table 72 by the pick-up robot 70 and is subsequently placed, with its rear side upside, by the supply arm 73 on the chuck table 30 standing by at the attachment/detachment position and being in vacuum operation. Since the wafer 1 is positioned by the positioning table, it is disposed concentrically with the chuck table 30. The wafer 1 is sucked and held on the upper surface of the chuck table 30 in such a manner that the protection tape 7 on the front surface side of the wafer 1 is in close contact with the upper surface thereof and the rear surface is exposed.

The turn table 20 is next turned in the direction of arrow R of FIG. 2 so that the chuck table 30 holding the wafer 1 is stopped at the rough grinding position below the rough grinding unit 40A. At this time, a subsequent chuck table 30 is positioned at the attachment/detachment position and a wafer 1 to be next ground is placed thereon in the manner as described above. The thickness-measuring gauge 25 and the rough grinding unit 40A are set up as below for the wafer 1 positioned at the rough grinding position. As regard the thickness-measuring gauge 25, the tip of the reference probe of the reference side height gauge 26 is brought into contact with the upper surface 31*a* of the frame 31 of the chuck table 30. In addition, the tip of the variation probe 27*a* of the wafer side height gauge 27 is brought into contact with an area that is included in the upper surface of the wafer 1 held on the chuck table 30 and corresponds to the device formation area 4 to be roughly ground.

The rough grinding unit 40A is appropriately moved in the inter-axis direction by the X-axis transfer mechanism 50. As shown in FIGS. 3A and 3B, the rough grinding wheel 45 faces the rear surface of the wafer 1 so as to be positioned at a recessed portion formation position where the blade edges of the grinding stones 45*b* pass the vicinity of the rotational center of the wafer 1 and the outer circumferential edge of the device formation area 4. In this case, the recessed portion formation position is located closer to the outer circumferential side of the turn table 20 than the rotational center of the wafer 1. The recessed portion 1A (see FIG. 6B) formed in the rear surface of the wafer is an area corresponding to the device formation area 4 and is arranged in a circular area avoiding the notch 6 as a portion drawn by a circular line 1*a* of FIG. 5. The recessed portion 1A is eccentric to the wafer 1, that is, the center of the recessed portion 1A is located at a position slightly offset from the center of the wafer 1 to a side opposite to the notch 6 by 180°. Thus, the outer circumferential portion (an annular protruding portion indicated with symbol 5A in FIG. 6A) that is formed around the recessed portion 1A by the formation of the recessed portion 1A so as to have the original thickness has a width that is widest at a portion close to the notch 6 and narrowest at a position farthest from the notch 6.

The formation of the recessed portion 1A avoiding the notch 6 as described above can prevent the occurrence of chip stemming from the notch 6 during the rough grinding. The annular protruding portion 5A has a width of about e.g. 2 to 3 mm. If the recessed portion 1A (corresponding to the circular line 1*a*) is eccentric, the width widest at the portion close to the notch 6 is 3 to 4 mm. Preferably, the width of the annular protruding portion 5A is as narrow as possible to the extent that a chip is unlikely to occur stemming from the notch 6 and in a range where a load is not increased during the finishing grinding.

The rough grinding wheel 45 is positioned at the recessed portion formation position with respect to the wafer 1 positioned at the rough grinding position. Then, while the wafer 1 is rotated in one direction by rotating the chuck table 30, the rough grinding unit 40A is lowered by the Z-axis transfer mechanism 60 with the rough grinding wheel 45 rotated at high speeds, and the grindstones 45*b* are pressed against the rear surface of the wafer 1. Thus, the circular area drawn with the circular line 1*a* of FIG. 5 in the rear surface of the wafer 1 is ground to form a ground area in the recessed portion 1A as shown FIGS. 6A and 6B and the annular protruding portion 5A with the original thickness at the outer circumferential portion around the recessed portion 1A. The device formation area 4 grounded by rough grinding is reduced in thickness to e.g. a final finishing thickness plus about 20 to 40 μm (a first grinding step).

The ground amount is measured by the thickness-measuring gauge 25. When the ground amount reaches a target ground amount for rough grinding, the lowering of the rough grinding wheel 45 by the Z-axis transfer mechanism 60 is stopped. Then, the rotation of the rough grinding wheel 45 is kept as it is for a given period of time and the rough grinding unit 40A is lifted to end the rough grinding. As shown in FIG. 6A, the wafer 1 that has roughly been ground is such that grinding marks 9*a* exhibiting a pattern where a large number of arcs are drawn are left on the bottom surface 4*a* of the recessed portion 1A. The grinding marks 9*a* are trajectories of fragmentation processing by the abrasive grains in the grindstones 45*b* and form a mechanical damage layer including micro cracks or the like.

The wafer 1 that has roughly been ground 1 is transferred to the finishing grinding position below the finishing grinding unit 40B by rotating the turn table 20 in the direction of symbol R. The wafer 1 that has preliminarily been held by the chuck table 30 located at the attachment/detachment position is transferred to the rough grinding position where the rough grinding described above is performed in parallel with the precedent rough grinding. Further, a wafer 1 to be next processed is placed on the chuck table 30 transferred to the attachment/detachment position.

When the wafer 1 is positioned at the finishing grinding position, the thickness-measuring gauge 25 disposed on the finishing grinding side and the finishing grinding unit 40B above the thickness-measuring gauge 25 are set up for the wafer 1 as below. As regard the thickness-measuring gauge 25, the tip of the reference probe 26*a* of the reference side height gauge 26 is brought into contact with top of the chuck table 30, specifically, the upper surface 31*a* of the frame 31 of the chuck table 30. In addition, the tip of the variation probe 27*a* of the wafer side height gauge 27 is brought into contact with the bottom surface 4*a* of the recessed portion 1A formed.

The finishing grinding unit 40B is appropriately transferred in the inter-axis direction by the X-axis transfer mechanism 50. The blade edge of the grindstone 46*b* of the finishing grinding wheel 46 passes the rotational center of the wafer 1. In addition, as shown in FIG. 7A, the grindstone 46*b* is located closer to the outer circumferential side than the inner circumferential lateral surface 5B of the recessed portion 1A. The entire surface of the blade edge of the grindstone 46*b* comes into contact with the upper surface of the annular protruding portion 5A, that is, the blade edge of the grindstone 46*b* is positioned so as to be able to grind the inner circumferential lateral surface 5B. Also this position where the inner circumferential lateral surface can be ground is closer to the outer circumferential side of the turn table 20 than the rotational center of the wafer 1. The wafer 1 is then rotated in one direction by rotating the chuck table 30. At the same time, the finishing grinding unit 40B is lowered by the Z-axis transfer mechanism 60 while rotating the finishing grinding wheel 46 of the finishing grinding unit 40B.

When the finishing grinding unit 40B is lowered, the grindstone 46*b* of the finishing grinding wheel 46 is pressed against the inner circumferential side upper surface of the annular protruding portion 5A to grind the inner circumferential lateral surface 5B while the pressed portion of the annular protruding portion 5A is crushed. For the finishing grinding, the inner circumferential lateral surface 5B is first ground as described above and then the entire surface of the inner circumferential lateral surface 5B is ground. Subsequently, the finishing grinding unit 40B is lowered and grinds the bottom surface 4*a* of the recessed portion 1A. A targeted finishing ground amount, namely, an amount of grinding the bottom surface 4*a* of the recessed portion 1A is e.g. 20 to 40 μm as described above (a second grinding step).

Figure 7B:
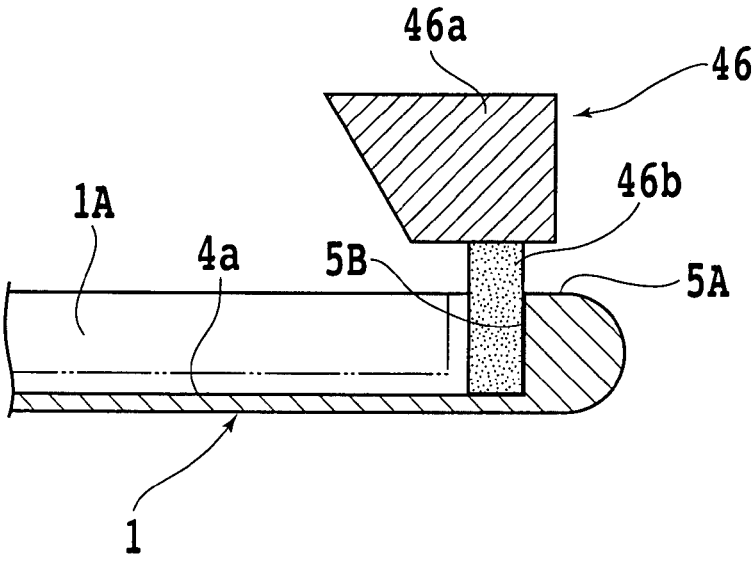

The amount of grinding the bottom surface 4*a* of the recessed portion 1A is measured by the thickness-measuring gauge 25. When it is confirmed that the targeted finishing grinding amount is reached, the lowering of the finishing grinding wheel 46 by the Z-axis transfer mechanism 60 is stopped. Then, the rotation of the finishing grinding wheel 46 is kept as it is for a given period of time and the finishing grinding unit 40B is lifted to end the finishing grinding. FIG. 7B illustrates the state just before the finishing grinding unit 40B is lifted. In the figure, a broken line indicates the recessed portion 1A formed by the rough grinding, namely, the recessed portion 1A before the finishing grinding. The grinding marks 9*a* formed by the rough grinding shown in FIG. 6A is removed by the finishing grinding. However, new grinding marks 9*a* formed by the finishing grinding as shown in FIG. 4A is left in the inner surface of the recessed portion 1A.

Operation conditions suitable for the rough grinding and finishing grinding are cited by way of examples. For both the rough grinding unit 40A and finishing grinding unit 40B, the rotation speeds of the grinding wheels 45, 46 are about 3000 to 5000 rpm and the rotation speeds of the chuck tables 30 are about 100 to 300 rpm. The processing transfer speed or lowering speed of the rough grinding unit 40A is 4 to 6 μm/sec. On the other hand, the lowering speed of the finishing grinding unit 40B is 4 to 6 μm/sec for the processing for grinding the annular protruding portion 5A and about 0.5 μm/sec for the final stage for grinding the bottom surface 4*a* of the recessed portion 1A.

After the finishing grinding and rough grinding performed concurrently with each other are finished, the turn table 20 is turned in the direction of symbol R to transfer the wafer 1 that has been finishing-ground to the attachment/detachment position. Along with this, the subsequent wafers 1 are respectively transferred to the rough grinding position and the finishing grinding position. The wafer 1 on the chuck table 30 positioned at the attachment/detachment position is transferred to the cleaning system 75 and cleaned with water and dried. The wafer 1 cleaned by the cleansing system 75 is transferred by the pick-up robot 70 into the recovery cassette 76 for storage.

That is a cycle in which the recessed portion 1A is formed in the rear surface of the one wafer 1 by the rough grinding, the inner surface of the recessed portion 1A is next finishing-ground and a portion of the wafer 1 corresponding to the device formation area 4 is reduced in thickness to a given thickness. The wafer-grinding apparatus 10 of the present embodiment can efficiently perform the processing for grinding the plurality of wafers 1 by concurrently performing the rough grinding at the rough grinding position and the finishing grinding at the finishing grinding position on the corresponding wafers 1 while intermittently turning the turn table 20 as described above.

According to the present embodiment, the entire inner surface of the recessed portion 1A can be processed into a planar plane whose mechanical damage layer has a low level by the two-stage grinding in which the recessed portion 1A is formed by the rough grinding and thereafter the inner surface of the recessed portion 1A is finishing-ground. At the time of finishing grinding, since a slightly increased thickness portion of the annular protruding portion 5A on the inner circumferential side thereof is ground, a grinding load is not large even if the grindstone 46 for finishing grinding is used. Thus, the finishing grinding can be performed at the same transfer speed as that for the rough grinding, namely, at 4 to 6 μm/sec as mentioned above. When the bottom surface 4*a* is ground after the inner circumferential lateral surface 5B has been ground, a load is increased. Therefore, the transfer speed is adjusted to a low speed (about 0.5 μm/sec) suitable for the finishing grinding as described above.

As shown FIGS. 7A and 7B, in the present embodiment, the finishing grinding wheel 46 is used whose finishing grindstone 46*b* is located closer to the outer circumferential side of the recessed portion 1A than the inner circumferential side thereof. In addition, the entire surface of the blade edge of the grindstone 46*b* is pressed against the annular protruding portion 5A to grind the inner circumferential lateral surface 5B. Thus, biased wear does not occur at the blade edge of the grindstone 46*b* and the grinding load is not large as described above. This makes it possible to form the inner corner portion, at a right angle, between the bottom surface 4*a* of the recessed portion 1A and the inner circumferential lateral surface 5B of the annular protruding portion 5A. Thus, the entire area of the bottom surface corresponding to the device formation area 4 can be processed to a uniform thickness, with the result that a disadvantage that the yield of the semiconductor chips 3 is reduced can be prevented.

Figure 8A:
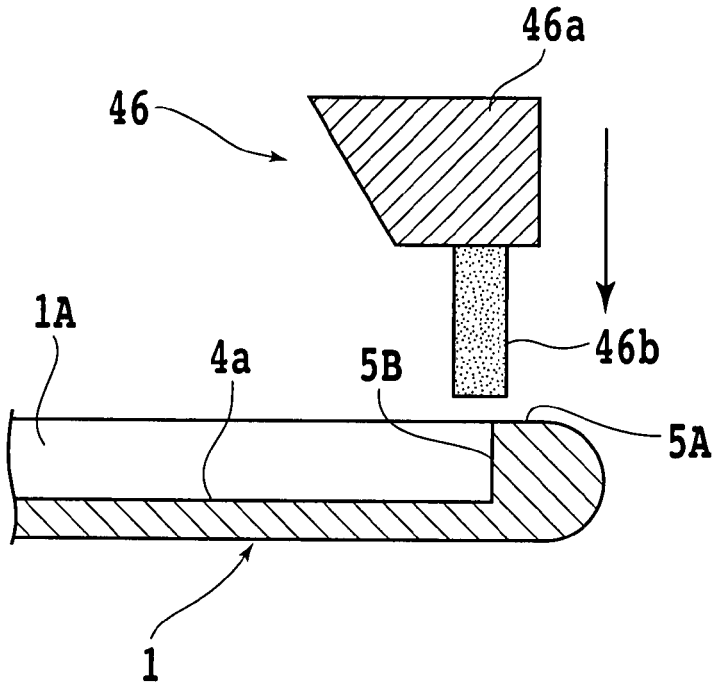
FIGS. 8A and 8B illustrate unpreferable arrangement of a finishing grindstone by way of example.
Figure 8B:
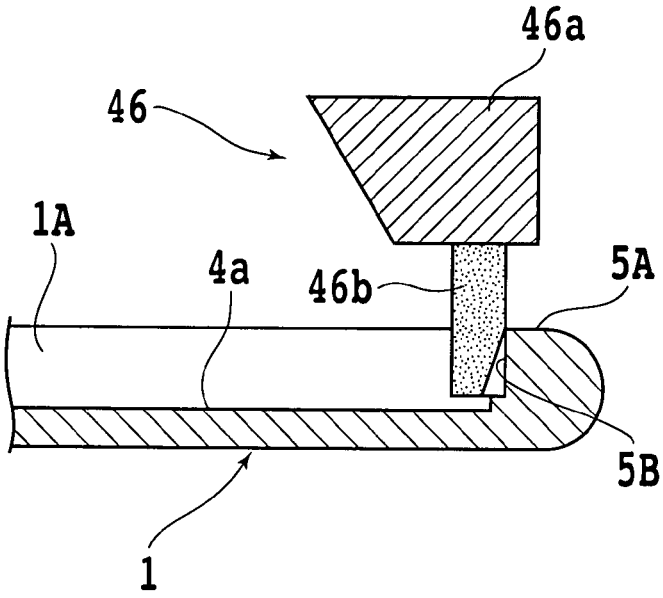

Incidentally, as shown in FIGS. 8A and 8B, the inner circumferential lateral surface 5B can be ground even in the state where it is coincident with the width portion of the finishing grindstone 46*b*. However, in this case, biased wear occurs in which only the outer circumferential side of the grindstone 46*b* is worn away (a blank portion of the grindstone 46*b* is worn away in FIG. 8B). The virtual operating life of the grindstone 46*b* is undesirably shortened.

Figure 9A:
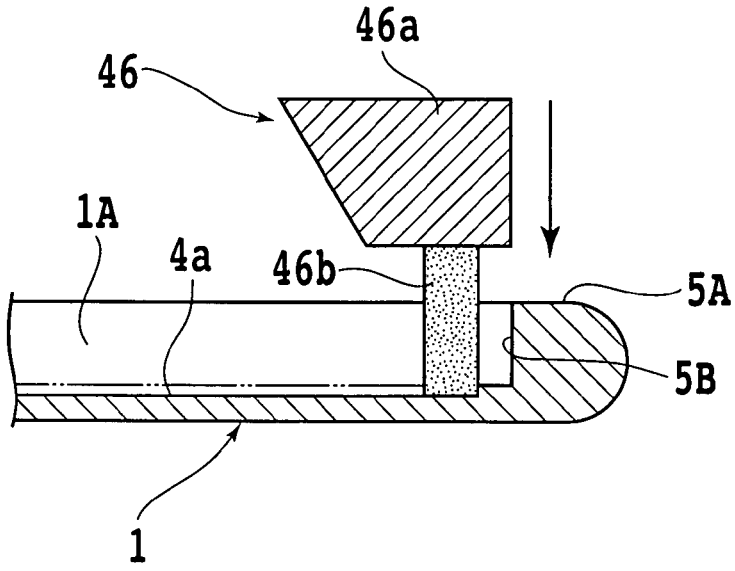
FIGS. 9A and 9B are cross-sectional views illustrating steps for grinding the rear surface of a wafer for finishing-grinding the inner surface of the recessed portion by a method according to another embodiment of the present invention.
Figure 9B:
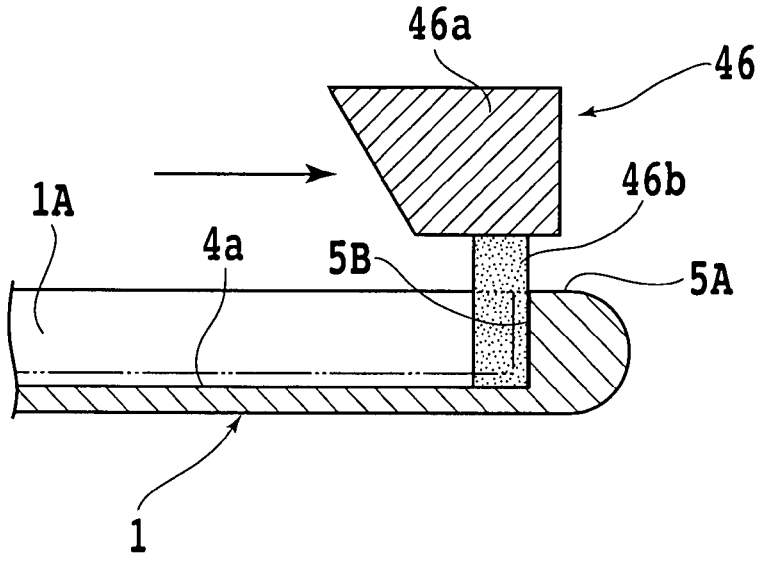
Figure 10A:
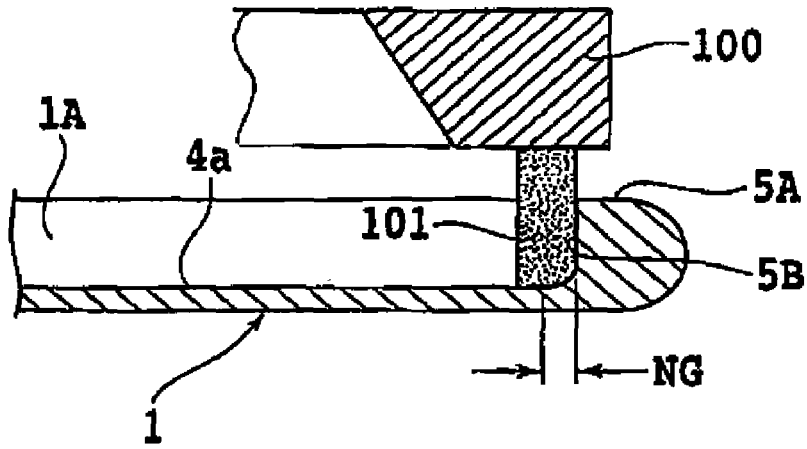
FIG. 10A PRIOR ART
FIGS. 10*a*, 10B and 10C are cross-sectional views illustrating a conventional method for forming a recessed portion by grinding the rear surface of a wafer.
Figure 10B:
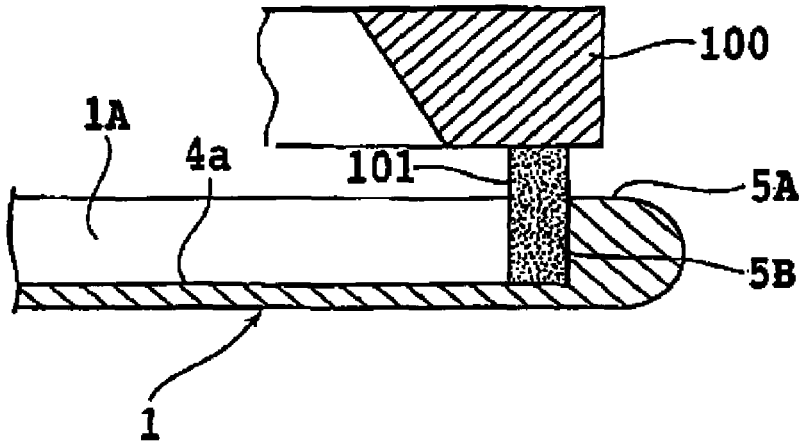
FIG. 10B PRIOR ART
Figure 10C:
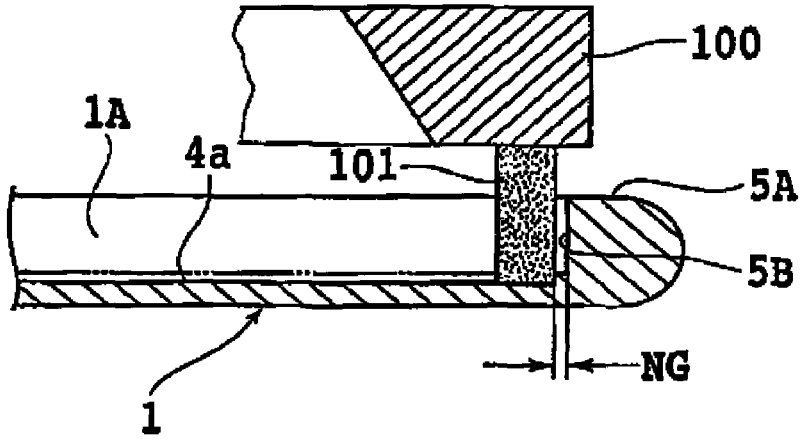
FIG. 10C PRIOR ART

Finishing grinding according to another embodiment is next described with reference to FIGS. 9A and 9B. In the finishing grinding in this case, as shown in FIG. 9A, the grindstone 46*b* is slightly spaced apart from the inner circumferential lateral surface 5*b* and the bottom surface 4*a* of the recessed portion 1A is first ground. While a large portion of the bottom surface 4*a* is first finishing-ground, the outermost circumferential portion is not ground, namely, is left in a roughly ground and steplike manner. After the finishing-grinding of the bottom surface 4*a* is completed, while the rotation of the finishing grinding wheel 46 and chuck table 30 and the Z-axial position of the grinding unit 40 are maintained, the grinding unit 30 is horizontally moved in the direction of the inner circumferential lateral surface 5B by the X-axis transfer unit 30 to press the outer circumferential surface of the grindstone 46*b* against the inner circumferential lateral surface 5B. Thus, the outermost circumferential portion of the bottom surface 4*a* left in the steplike manner is ground by the movement of the grinding unit 30, evenly finishing-grinding the entire bottom surface 4*a*. In addition, also the inner circumferential lateral surface 5B against which the outer circumferential surface of the grindstone 46*b* is pressed is finishing-ground.

The finishing grinding of the present embodiment is a method in which a combination of the lowering and horizontal movement of the grinding unit 30 first grinds the bottom surface 4*a* of the recessed portion 1A and then the inner circumferential lateral surface 5B by e.g. about 1 mm, thus grinding the entire inner surface of the recessed portion 1A. Similarly to the embodiment described earlier, also the present embodiment can form the inner corner portion, at a right angle, between the bottom surface 4*a* of the recessed portion 1A and the inner circumferential lateral surface 5B of the annular protruding portion 5A. Thus, a reduction in the yield of the semiconductor chips 3 can be prevented.

Figure 5:
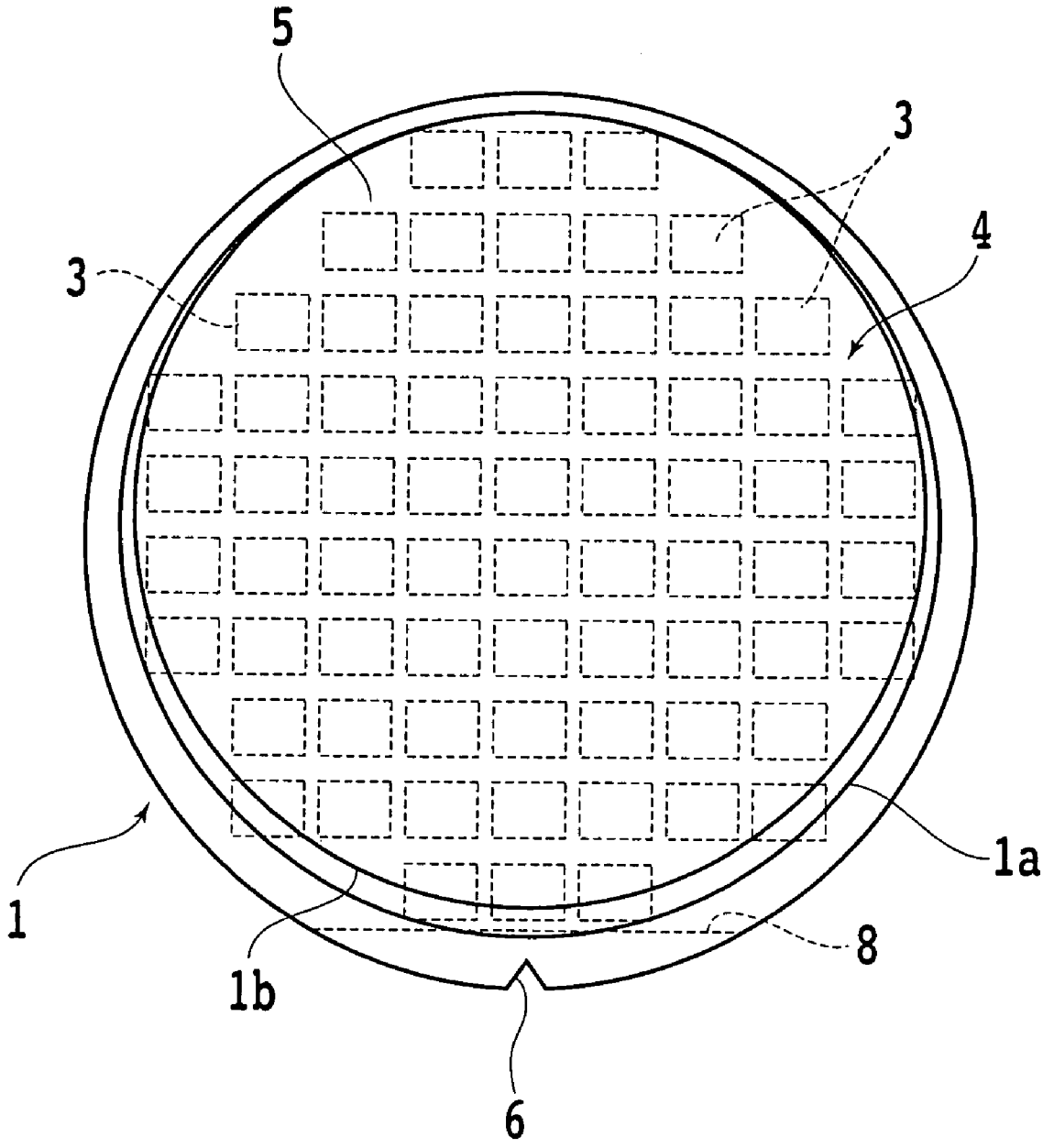
FIG. 5 is a view of the rear surface of the wafer illustrating the area of a recessed portion formed in the wafer rear surface during a rough grinding step.

While the wafer 1 described with the above embodiments is formed with the notch 6 as a mark indicting crystal orientation, an orientation flat 8 shown in FIG. 5 may be employed as a crystal orientation mark. The orientation flat 8 is such that a portion of the outer circumferential edge of the wafer 1 is notched linearly along the tangential direction. The wafer 1 formed with such an orientation flat 8 is formed with the recessed portion 1A at a portion drawn by the circular line 1*b* which recedes from the circular line 1*a* while avoiding the orientation flat 8. The wafer formed with the orientation flat 8 has the recessed portion 1A formed smaller than that formed with the notch 6 and the annular protruding portion 5A having a width, near the orientation flat 8, e.g. about two times (e.g. about 4 to 8 mm) wider than that formed with the notch 6.

If the width of the annular protruding portion 5A must be relatively wide as described above, it is possible to more accurately control the ground amount of the finishing grinding by individually measuring the thickness of the annular protruding portion 5A at the time of finishing grinding. However, because of the increased width of the annular protruding portion 5A, the load during the finishing grinding is increased and the grinding outer diameter of the rough grindstone 45*b* is small. Wear management is likely to be cumbersome. Thus, it is desired that the receding amount adapted to avoid the orientation flat 8 be an appropriate amount.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A method of grinding a wafer having a device formation area formed with a plurality of devices on a front surface thereof, comprising:

a first grinding step in which the wafer is held on a rotatable chuck table with a rear surface thereof upward, and an area of the rear surface corresponding to the device formation area is ground by an annular rotary type first grindstone or an annularly arranged rotary type first grindstones to form a recessed portion in the rear surface side of the wafer, thereby forming an annular protruding portion protruding from the rear surface side around the device formation area; and a second grinding step by using a second grindstone which is an annular rotary type grindstone or annularly arranged rotary type grindstones and which has an abrasive grain size smaller than that of the first grindstone, said second grinding step comprising the steps of:

positioning the second grindstone spaced apart from an inner circumferential lateral surface of the annular protruding portion and grinding a bottom surface of the recessed portion to thereby form an annular step-shaped portion at the outermost circumferential portion of the bottom surface;

moving the second grindstone radially outward towards the inner circumferential lateral surface of the annular protruding portion while rotating the second grindstone and the chuck table to thereby grind and remove the annular step-shaped portion; and further moving the second grindstone radially outward to grind the inner circumferential lateral surface of the annular protruding portion.

* * * * *